US006455216B2

(12) United States Patent
Nagahama et al.

(10) Patent No.: US 6,455,216 B2
(45) Date of Patent: Sep. 24, 2002

(54) TONER FOR DEVELOPING ELECTROSTATIC LATENT IMAGES, METHOD FOR FORMING IMAGES AND APPARATUS FOR FORMING IMAGES

(75) Inventors: Hitoshi Nagahama, Uji; Toshihiko Murakami; Katsuaki Sumida, both of Kashiba, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/811,576

(22) Filed: Mar. 20, 2001

(30) Foreign Application Priority Data

Apr. 28, 2000 (JP) ..... 2000-130162

(51) Int. Cl.[7] ..... G03G 9/087; G03G 9/097

(52) U.S. Cl. ..... 430/108.23; 430/109.4; 430/97; 430/111.4

(58) Field of Search ..... 430/108.23, 109.4, 430/111.4, 97

(56) References Cited

U.S. PATENT DOCUMENTS 5,665,512 A * 9/1997 Tsutsui et al. ..... 430/108.23
5,843,605 A * 12/1998 Anno et al. ..... 430/109.4
6,284,422 B1 * 9/2001 Nagahama et al. .... 430/108.23

* cited by examiner

*Primary Examiner*—Christopher Rodee
(74) *Attorney, Agent, or Firm*—Nixon & Vanderhye P.C.

(57) ABSTRACT

A toner for developing electrostatic latent images comprises: a colorant; a polyester resin; a negative charge controlling agent comprised of a chromium complex compound; and a positive charge controlling agent, wherein the polyester resin has an acid value Z of 15 to 33 mgKOH/g, a hydroxyl value Y of 4 to 17 mgKOH/g and a number-average molecular weight (Mn) of 5200–7000.

13 Claims, No Drawings

TONER FOR DEVELOPING ELECTROSTATIC LATENT IMAGES, METHOD FOR FORMING IMAGES AND APPARATUS FOR FORMING IMAGES

CROSS-REFERENCES TO RELATED APPLICATIONS

This application is related to Japanese Patent Application No. HEI 12(2000)-130162, filed on Apr. 28, 2000 whose priorities are claimed under 35 USC § 119, the disclosures of which are incorporated by reference in their entirety.

BACKGROUND OF THE INVENTION

1.Field of the Invention

The present invention relates to a toner for developing electrostatic latent images, a method for forming images and an apparatus for forming images using the toner. More particularly, the present invention relates to a toner for developing electrostatic latent images which contains a polyester resin with specific properties, a method for forming images and an apparatus for forming images using the toner.

2.Description of Related Art

Highly charge-receptive toners have been proposed (for example, Japanese Unexamined Patent Publication No. HEI 5(1993)-72805) which exhibit a good triboelectrification property and are not liable to form blurs in print and spots in non-printed part, not only in developing apparatuses used by a two-component developing method which is a dry development method but also in developing apparatuses used by a one-component developing method in which toners are not in frequent contact with charge donor members and in developing apparatuses in which charge donor members have a poor charge donating efficiency.

The toner of the above-mentioned publication is comprised of a polyester resin, a colorant and an electric charge controlling agent. As the polyester resin, used is one having an acid value not greater than 15 mgKOH/g, and as the electric charge controlling agent, used is a chromium complex compound represented by the following formula:

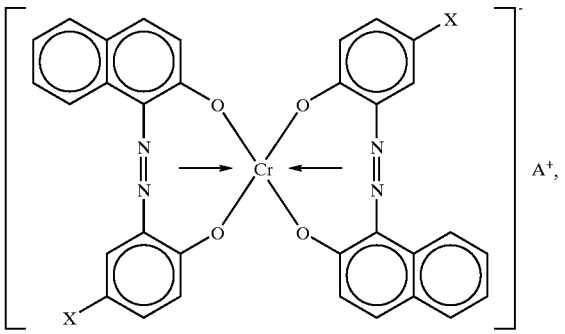

wherein X is Cl, Br, $SO_2NH_2$, $SO_2CH_3$ or $SO_2C_2H_5$, and $A^+$ is a $C_{8-16}$ straight-chain alkylammonium or a $C_{8-16}$ branched alkylammonium in which the alkyl moiety is optionally interrupted by a hetero atom.

The reason why the acid value of the polyester resin in the above toner is 15 mgKOH/g or less is that, if the acid value is over 15 mgKOH/g, free carboxyl groups contained in the polyester resin, which have electron receptivity, improve negative electrification of the toner itself, while chelated rings of a chromium complex compound become liable to decompose. Therefore, the chromium complex compound is prevented from displaying its function as an electric charge controlling agent sufficiently. Especially, if the acid value exceeds 25 mgKOH/g, time constant until the triboelectrified amount of the toner reaches its saturation becomes large, and therefore, sufficient amount of electrification is difficult to obtain in the developing apparatus.

On the other hand, if the acid value is 10 mgKOH/g or below, the chromium complex compound is not decomposed at chelate rings due to the effect of carboxyl groups, which brings extremely good electrification characteristics by synergism with readiness to negative electrification that the polyester resin has.

However, if the acid value of the polyester resin is 15 mgKOH/g or below, excellent negative electrification and offset-resistant intrinsic to the polyester resin are restricted. Therefore, a problem lies in that the polyester resin cannot fully exhibit its excellent properties.

SUMMARY OF THE INVENTION

The inventors of the present invention have made intensive studies for a toner for developing electrostatic latent images which has sufficient electrification characteristics and does not bring about problems such as blushing, toner scattering and the like while maintaining the property of negative electrification and the property of offset-resistance at fixation intrinsic to the polyester resin. As a result, we have found that the acid value and hydroxyl value of the polyester resin contained in the toner for developing electrostatic latent images have a close relation with the electrification characteristics, especially in a high-temperature high-humidity environment, and that reduction in image density when a low-density manuscript is copied is prevented if the number-average molecular weight (Mn) of the polyester resin is within a specific range, finally to achieve the present invention.

Accordingly, the present invention provides a toner for developing electrostatic latent images comprising: a colorant; a polyester resin; a negative charge controlling agent comprised of a chromium complex compound; and a positive charge controlling agent, wherein the polyester resin has an acid value Z of 15 to 33 mgKOH/g, a hydroxyl value Y of 4 to 17 mgKOH/g and a number-average molecular weight (Mn) of 5200~7000.

The present invention also provides a method for forming images and an apparatus for forming images using the above-mentioned toner.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The toner for developing electrostatic latent images of the present invention mainly contains a colorant, a polyester resin, a negative charge controlling agent comprised of a chromium complex compound, and a positive charge controlling agent.

The polyester resin used in the toner of the present invention is a polymer combined by ester bonding through polycondensation of a polybasic acid and a polyhydric alcohol. The polymer may be saturated or unsaturated. The kind of the polyester resin is not particularly limited, and examples thereof include various polymers such as unsaturated polyester resins, alkyd resins, polyethylene terephthalates, polybutylene terephthalates, polyarylates and the like, among which unsaturated polyester resins are preferred.

The kind of the polybasic acid forming the polyester resin is not particularly limited, and examples thereof include maleic acid, maleic anhydride, fumaric acid, citraconic acid, itaconic acid, mesaconic acid, phthalic anhydride, isophthalic acid, terephthalic acid, succinic anhydride, adipic acid, azelaic acid, sebacic acid, tetrahydrophthalic anhydride, hexahydrophthalic anhydride, tetrabromophthalic anhydride, tetrachlorophthalic anhydride, HET anhydride, endomethylene tetrahydrophthalic anhydride, trimellitic acid, trimellitic anhydride, pyromellitic acid, pyromellitic anhydride and the like.

The kind of the polyhydroxy alcohol is not particularly limited, and examples thereof include ethylene glycol, propylene glycol, 1,3-butanediol, 1,4-butanediol, 1,3-butylene glycol, 1,6-hexanediol, 1,5-pentanediol, 1,6-pentanediol, diethylene glycol, dipropylene glycol, neopentyl glycol, triethylene glycol, hydrogenated bisphenol A, polyoxyethylenated bisphenol A, polyoxypropylenated bisphenol A, bisphenol dihydroxypropyl ether, glycol, glycerol and the like.

The polyester resin may contain one or two or more of the above-mentioned polybasic acids and one or two or more of the above-mentioned polyhydroxy alcohols.

In the present invention, the polyester resin has an acid value Z of 15 to 33 mgKOH/g, i.e., $15 \leqq Z \leqq 33$ (preferably $15 < Z \leqq 33$, more preferably $15 < Z \leqq 25$) and a hydroxyl value Y of 4 to 17 mgKOH/g, i.e., $4 \leqq Y \leqq 17$ (preferably $4 \leqq Y \leqq 11$). Here, the acid value means the number of carboxyl residues at the end of the polyester resin, which is normally a value determined by a method in conformity to JIS K0070-1966. The hydroxyl value means the number of hydroxyl residues at the end of the polyester resin, which is normally a value determined by a method in conformity to JIS K0070-1916. The acid value can be raised by increasing the use ratio of the polybasic acid (e.g., trimellitic anhydride) with respect to a dibasic acid in the polyester resin. For example, the acid value can be raised by adding about 1 to 5% of trimellitic anhydride as well as about 1 to 5% of maleic anhydride. The hydroxyl value can be decreased by reducing end groups of the alcoholic component. The hydroxyl value can be adjusted within the above-mentioned range by adding terephthalic acid or adjusting added terephthalic acid slightly. A polyester resin comprised of a polybasic acid having an aromatic ring and a polyhydric alcohol is preferred because of its good blocking resistance. Especially preferred is a polyester resin produced by reacting a polyol with a polycarboxylic acid containing an aromatic tricarboxylic acid or its derivative.

The polyester resin of the present invention has a number average molecular weight (Mn) of about 5200–7000, more preferably about 5700–6400. Generally, the number average molecular weight Mn is defined by the formula when Ni molecules of a resin having a molecular weight Mi are present in a unit volume: $Mn = \Theta Mi \cdot Ni / \Sigma Ni$. The number average molecular weight can be measured by a cryoscopic method, an ebulliometric method, osmometry, gel permeation chromatograpy (GPC) or the like method, among which the GPC is preferred.

Generally, when a low-density manuscript is copied over a long time (for example, when a manuscript of a 1% character area occupation is copied in a FAX mode over a long time), because the toner in the developing apparatus is replaced less often, more of the toner is over-agitated. As a result, particles of the fluidizing agent carried on the surface of the toner are buried below the surface of the toner, which leads to a decline in the fluidity of the toner and consequently a decline in the supply of the toner to an electrostatic latent image on a photo conductor. That in turn causes defects such as ununiformity in copy images. If the number average molecular weight is within the above-mentioned range, however, the burying of the fluidizing agent particles is suppressed and ununiformity in copy images is prevented, thereby to obtain extremely good copy images without impeding fixation of the toner.

The polyester resin of the present invention is usually obtained by condensation reaction with dehydration or by ester exchange reaction of materials as mentioned above in an organic solvent in the presence of a catalyst. The reaction temperature is for example about 150 to 300° C. When the above-mentioned reaction is carried out, an esterifying catalyst or an ester exchange catalyst such as magnesium acetate, zinc acetate, lead acetate, antimony trioxide or the like may be used for the purpose of accelerating the reaction.

In the present invention, for example, the amount of maleic anhydride and trimellitic anhydride may be increased to obtain a polyester resin having a relatively large acid value, thereby to improve the offset-resistant and also the negative electrification property. Also a polyester resin having a relatively small hydroxyl value may be used, thereby to suppress moisture absorption and improve electrification stability against ambience, that is, to obtain the electrification stability even in a hot and humid environment.

Preferably the polyester resin of the present invention has a glass transition point (Tg) of about 60 to 70° C. (measured by a method in conformity to ASTM D3418-82). If the glass transition point is within this range, the polyester resin has improved blocking resistance and/or improved offset resistance.

Preferably the polyester resin of the present invention has a 4 mm-descending temperature at about 160 to 175° C. (measured by a method of raising temperature at uniform velocity using flow tester, 6° C./min., load: 20 kg, die: 1 mm×0.5 mmϕ, CFT 500 manufactured by SHIMADZU CORPORATION, Japan). If the 4 mm-descending temperature is within this range, the polyester resin has an improved fixation and/or an improved offset-resistant.

The negative charge controlling agent comprised of a chromium complex compound in the present invention is not particularly limited to any kind, but for example, may be mentioned a chromium complex compound represented by the following formula:

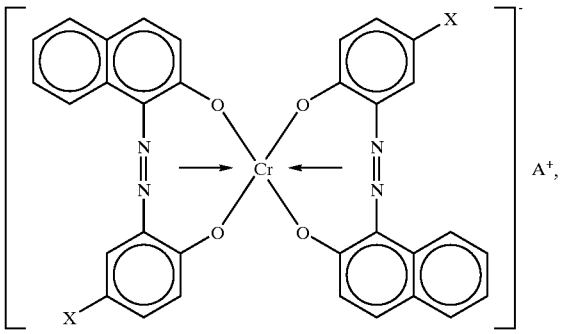

wherein X is Cl, Br, $SO_2NH_2$, $SO_2CH_3$ or $SO_2C_2H_5$, and $A^+$ is a $C_{8-16}$ straight-chain alkylammonium or a $C_{8-16}$ branched alkylammonium in which the alkyl moiety is optionally interrupted by a hetero atom.

Here, as the hetero atom, may be mentioned nitrogen atom, oxygen atom, sulfur atom and the like, among which oxygen atom is preferable.

As the $C_{8-16}$ straight-chain alkylammonium, may be mentioned $^+NH_3C_{12}H_{25}$, $^+NH_3C_{12}H_{29}$ and the like.

As the $C_{8-16}$ branched alkylammonium optionally interrupted by a hetero atom, may be mentioned $^+NH_3C_3H_6OC(C_2H_5)HC_4H_9$, $^+NH_3C_3H_6OCH_2C(C_2H_5)HC_4H_9$ and the like.

The toner for developing electrostatic latent images of the present invention preferably contains about 80 to 95 wt %, more preferably about 85 to 90wt %, of the polyester resin and about 0.5 to 5 wt %, more preferably about 1 to 3 wt %, of the chromium complex compound, with respect to the total weight of the toner.

The toner of the present invention may further contain a positive charge controlling agent. As positive charge controlling agents usable here, may be mentioned nigrosine dyes, pyridinium salts, ammonium salts or lake compounds thereof, for example. The positive charge controlling agent is preferably contained in a range of about 0.05 to 0.5 wt %, more preferably about 0.1 to 0.3 wt %, with respect to the total weight of the toner.

The toner of the present invention may further contain a colorant which can usually be used for toners. As examples of colorants, may be mentioned carbon black, magnetic powder, nitro dyes, stilbeneazo dyes, diphenylmethane dyes, triphenylmethane dyes, methine dyes, thiazole dyes, anthraquinone dyes, imidamine dyes, azine dyes, oxazine dyes, thiazine dyes, sulfur dyes, indigoid dyes, phthalocyanine dyes and the like organic dyes and pigments.

Preferably the toner of the present invention further contains particles of a fluidizing agent. As the fluidizing agent particles to be used in the present invention, may be mentioned silica particles, titanium dioxide particles, aluminum oxide particles and the like, among which silica particles are preferred. The fluidizing agent particles have a specific surface area preferably within the range of about 90 to 240 $m^2/g$ (measured by a BET method), more preferably within the range of about 100 to 220 $m^2/g$ and still more preferably within the range of about 110 to 220 $m^2/g$. The fluidizing agent particles are contained preferably in a range of about 0.1 to 3.0 wt %, more preferably in a range of about 0.3 to 1.0 wt %, with respect to the total weight of the toner.

It is generally preferred that air exists between the particles of the toner because the fluidity of the toner is provided by the spacer effect. Therefore, if the fluidizing agent particles have a specific surface area within the above-mentioned range, a sufficient amount of air exists between the toner particles and the spacer effect is favorably exhibited. As a result, the fluidity of the toner is not impaired even when a low density manuscript is copied. Moreover, aggregation of the fluidizing agent particles is suppressed and white spots are prevented from images copied.

The toner of the present invention may further contain additives such as a fixing/releasing agent, a dispersant, magnetic powder and the like which can usually be used for toners. Also, in addition to the polyester resin, other kinds of resins may be used.

As examples of fixing/releasing agents, may be mentioned natural wax such as montanic acid ester wax and carnauba wax; polyolefin wax such as high-pressure polyethylene and polypropylene; silicone wax; and fluorine wax.

As examples of dispersants, may be mentioned metallic soap, polyethylene glycol and the like.

As examples of magnetic powder, may be mentioned metals such as iron, cobalt, nickel, chromium and manganese, alloys thereof, and metal oxides such as chromium dioxide, ferric sesquioxide and ferrite.

As examples of other resins usable here, may be mentioned styrene resin, styrene-acrylic copolymer resin, styrene-acrylonitrile copolymer resin, acrylic resin, styrene-maleic anhydride copolymer resin, styrene-acrylic-maleic anhydride copolymer resin, polyvinyl chloride resin, polyvinyl acetate resin, polyolefin resin, polyurethane resin, urethane modified polyester resin, epoxy resin and the like.

The toner of the present invention may be produced by a known method, for example, by admixing materials using an apparatus capable of mixing such as an air-current mixer, e.g., a Henschel mixer, a super mixer, a mechanomill and a Q-type mixer; melting and kneading the materials at a temperature of about 70 to 180° C. using an apparatus such as a twin screw kneader or a single screw kneader; solidifying the resulting kneaded product by cooling and; grinding the solidified product by an air-current grinder such as a jet mill. Grinding is preferably so carried out that the toner particles are about 5 to 25 $\mu$m, more preferably, about 7 to 15 $\mu$m, in diameter.

The method for forming images of the present invention is not particularly limited so far as the above-mentioned toner is used, and can be any known method using electronic photography, electrostatic printing and the like or any method in conformance with these. Specifically, a method may be mentioned comprising the steps of forming an electrostatically charged image on a photo conductor, developing the electrostatically charged image using the above-mentioned toner to obtain a toner image, then transferring the toner image on the photo conductor to a transferring material, and fixing the toner mage thus transferred on the transferring material, thereby to form a fixed image.

The apparatus for forming images of the present invention may be any kind of apparatus which can realize the above-mentioned methods for forming images by use of the above-mentioned toner, and may be copying machines, printers, facsimile machines, complexes thereof and the like.

The toner for developing electrostatic latent images of the present invention is now described in further detail by way of example.

EXAMPLE 1

As shown in table 1;

100 parts by weight of polyester resin 1 (acid value 25, hydroxyl value : 11, number average molecular weight: 6000, produced by Sanyo Kasei Kogyo, Japan);

1.5 parts by weight of a negative charge controller (Aizen Spilon Black TRH, produced by Hodogaya Kagaku Kogyo, Japan);

0.2 parts by weight of a positive charge controller (Bontron N09, produced by Orient Kagaku, Japan);

5 parts by weight of carbon black (MA-77, produced by Mitsubishi Kagaku, Japan);

2 part by weight of polypropylene (Biscol 550P, produced by Sanyo Kasei Kogyo, Japan).

The above-mentioned materials were mixed, melted and kneaded by a twin-screw extruder, cooled and ground to obtain a toner having a particle diameter of 8 $\mu$m.

To the obtained toner, added were 0.5 parts by weight of silica (R976S, produced by Nippon Aerosil, Japan) as fluidizing agent particles to obtain a toner of Example 1.

EXAMPLE 2

A toner of Example 2 was obtained in the same manner as in Example 1 except that 100 parts by weight of polyester resin 2 (acid value: 20, hydroxyl value: 17, number average molecular weight: 5800, produced by Sanyo Kasei Kogyo, Japan), 0.2 parts by weight of a positive charge controller (Bontron N04, produced by Orient Kagaku, Japan), and 0.5 parts by weight of silica (R974, produced by Nippon Aerosil, Japan) as fluidizing agent particles were used instead of polyester resin 1, Bontron N09 and R976S.

EXAMPLE 3

A toner of Example 3 was obtained in the same manner as in Example 1 except that 100 parts by weight of polyester resin 3 (acid value: 15, hydroxyl value: 4, number average molecular weight: 6400, produced by Sanyo Kasei Kogyo, Japan), 0.2 parts by weight of a positive charge controller (Bontron P51, produced by Orient Kagaku, Japan), and 0.3 parts by weight of silica (R812S, produced by Nippon Aerosil, Japan) as fluidizing agent particles were used instead of polyester resin 1, Bontron N09 and R976S.

EXAMPLE 4

A toner of Example 4 was obtained in the same manner as in Example 1 except that 0.7 parts by weight of silica (HDK H3004, produced by Wacker, Japan) as fluidizing agent particles were used instead of R976S.

COMPARATIVE EXAMPLE 1

A toner of Comparative Example 1 was obtained in the same manner as in Example 1 except that 100 parts by weight of polyester resin 4 (acid value: 32, hydroxyl value: 18, number verage molecular weight: 5000, produced by Sanyo Kasei Kogyo, Japan), 0.2 parts by weight of a positive charge controller (Bontron N09, produced by Orient Kagaku, Japan), and 4.0 parts by weight of silica (RX50, produced by Nippon Aerosil, Japan) as fluidizing agent particles were used instead of polyester resin 1, Bontron N09 and R976S.

COMPARATIVE EXAMPLE 2

A toner of Comparative Example 2 was obtained in the same manner as in Example 1 except that 100 parts by weight of polyester resin 5 (acid value: 10, hydroxyl value: 13, number verage molecular weight: 4700, produced by Sanyo Kasei Kogyo, Japan), 0.2 parts by weight of a positive charge controller (Bontron N04 produced by Orient Kagaku, Japan), and 0.1 parts by weight of silica (300, produced by Nippon Aerosil, Japan) as fluidizing agent particles were used instead of polyester resin 1, Bontron N09 and R976S.

COMPARATIVE EXAMPLE 3

A toner of Comparative Example 3 was obtained in the same manner as in Example 1 except that 100 parts by weight of polyester resin 6 (acid value: 20, hydroxyl value: 3, number verage molecular weight: 7200, produced by Sanyo Kasei Kogyo, Japan), 0.2 parts by weight of a positive charge controller (Bontron P51, produced by Orient Kagaku, Japan), and 0.3 parts by weight of silica (R812, produced by Nippon Aerosil, Japan) as fluidizing agent particles were used instead of polyester resin 1, Bontron N09 and R976S.

COMPARATIVE EXAMPLE 4

100 parts by weight of polyester resin 7 (acid value: 25, hydroxyl value: 12, number verage molecular weight: 75000, produced by Sanyo Kasei Kogyo, Japan), 0.2 parts by weight of a positive charge controller (Bontron N09, produced by Orient Kagaku, Japan), and 0.3 parts by weight of silica (HDK H30, produced by Waker, Japan) as fluidizing agent particles were used instead of polyester resin 1, Bontron N09 and R976S.

The above-mentioned toners obtained in Examples 1 to 4 and Comparative Examples 1 to 4 were evaluated on image density, Q/M and toner fly by use of a digital copying machine AR-405 produced by Sharp Kabushiki Kaisha while conducting actual copying in hot and humid ambience (35° C., 85%). Also uniformity in solid shading was evaluated using the same copying machine while conducting actual copying in hot and humid ambience (20° C., 65%). Sheets of 8.5×11 inch were used as copying paper.

(1) Q/M was measured by collecting a developer in a developing device after actual copying of 80,000 sheets (using a 6% manuscript), by use of a blow-off powder charge measuring device TB-200 produced by Toshiba Chemical, Japan.

(2) The image density was measured by use of a PROCESS MEASUREMENTS RD914 produced by Macbeth, through actual copying of 80,000 sheets (using a 6% manuscript), and rated as ○ (good) when it was 1.35 or more and as × (bad) when it was less than 1.35.

(3) The toner fly was observed with the eye, through actual copying of 80,000 sheets (using a 6% manuscript), and rated as ○ when almost no stains were observed and as × when stains were observed.

(4) The uniformity in solid shading was observed with the eye, through actual copying of 20,000 sheets (using a 1% manuscript), and rated as ○ when uniformity was observed (underlying paper was not seen), as Δ when a little ununiformity was observed (part of underlying paper was seen) and as × when ununiformity was observed (underlying paper was seen in places).

Also the above-mentioned toners were each evaluated on the offset resistance at fixing. For evaluation, the fixing section of a digital copying machine AR-405 produced by Sharp Kabushiki Kaisha was modified to be variable in temperature. The toners were rated as ○ when offset occurred at temperatures of 140° C. or below on a lower temperature side and at temperatures of 220° C. or above on a higher temperature side and as × in other cases. Sheets of 8.5×11 inch were used as copying paper.

TABLE 1

| | Polyester Resin Acid value/ Hydroxyl value (mgKOH/g)/ Number verage molecular weight (Mn) | Charge Controller Negative/ Positive (product name/ parts by weight) | Fluidizing Agent Particles Product name/ Parts by weight | Fluidizing Agent Particles Specific Surface Area ($m^2/g$) |
|---|---|---|---|---|
| Example 1 | 25/11/ 6000 | TRH/N09 1.5/0.2 | AEROSIL R976S/0.5 | 110 |
| Example 2 | 20/17/ 5800 | TRH/N04 1.5/0.2 | AEROSIL R974/0.5 | 170 |
| Example 3 | 15/4/ 6400 | TRH/P51 1.5/0.2 | AEROSIL R812S/0.3 | 220 |
| Example 4 | 25/11/ 6000 | TRH/N09 1.5/0.2 | WACKER H3004/0.7 | 200 |
| Comparative Example 1 | 32/18/ 5000 | TRH/N09 1.5/0.2 | AEROSIL RX50/4.0 | 50 |
| Comparative Example 2 | 10/13/ 4700 | TRH/N04 1.5/0.2 | AEROSIL 300/0.1 | 300 |
| Comparative Example 3 | 20/3/ 7200 | TRH/P51 1.5/0.2 | AEROSIL R812/0.3 | 260 |
| Comparative Example 4 | 25/12/ 7500 | TRH/N09 1.5/0.2 | WACKER H3004/0.4 | 200 |

TABLE 2

| | Copying in Hot and Humid Environment Image Density | Copying in Hot and Humid Environment Q/M ($\mu$c/g) | Copying in Hot and Humid Environment Toner Fly with the eye | Low concentration manuscript uniformity in solid shading | Offset Resistance at Fixation Offset Occurance Lower Temp/ Higher Temp | General Evaluation |
|---|---|---|---|---|---|---|
| Example 1 | 1.40–1.45 ○ | 20–25 ○ | ○ | ○ | 130/230 | ○ |
| Example 2 | 1.40–1.43 ○ | 25–30 ○ | ○ | ○ | 125/225 ○ | ○ |
| Example 3 | 1.37–1.40 ○ | 32–37 | ○ | ○ | 140/220 ○ | ○ |
| Example 4 | 1.40–1.44 ○ | 25–28 | ○ | ○ | 130/230 ○ | ○ |
| Comparative Example 1 | 1.40–1.45 ○ | 15–20 | x | Δ | 120/240 ○ | x |
| Comparative Example 2 | 1.19–1.28 x | 35–40 | ○ | x | 115/225 ○ | x |
| Comparative Example 3 | 1.25–1.33 x | 30–35 | ○ | ○ | 145/270 x | x |
| Comparative Example 4 | 1.25–1.35 x | 27–34 | ○ | ○ | 150/290 x | x |

The toner for developing electrostatic latent images according to the present invention comprises a polyester resin; a negative charge controlling agent comprised of a chromium complex compound; and a positive charge controlling agent, wherein the polyester resin has an acid value Z of 15 to 33 mgKOH/g, a hydroxyl value Y of 4 to 17 mgKOH/g and a number-average molecular weight (Mn) of 5200–7000. Accordingly, the charge providing characteristics of a negative-electrification providing agent comprised of the chromium complex compound are not impaired, and the electrification characteristics of the toner are stabilized. Especially over a long time even in a high temperature and high humidity environment, the toner of the present invention does not bring about blushing and toner scattering at high density, has excellent offset resistance and is negatively electrified. Even in a toner low consumption printing and copying mode, the toner of the present invention can provide good copy images which are free from blushing, ununiformity in solid at high density and toner scattering.

Also, if the polyester resin has a glass transition point (Tg) of 60 to 70° C., the blocking resistance can be improved.

Further, the polyester resin has a 4 mm-descending temperature of 160 to 175° C. (measured by a a method of raising temperature at uniform velocity using flow tester), the fixation and/or offset resistance can be improved.

Moreover, if the toner of the present invention further contains fluidizing agent particles, they are not buried in the toner and can fully execute their intrinsic function, and ununiformity in copy images can be prevented and the fixation of the toner can be improved, to obtain excellent copy images.

Specifically, if the fluidizing agent particles are mixed in a proportion of 0.1 to 3.0% by weight with respect to the total weight of the toner or if they are silica of a specific surface area of 90 to 240 $m^2/g$, the good spacer effect can be obtained by the existence of a suitable amount of air between the particles of the toner, and the fluidity of the toner is not impeded even in low-density manuscript copying, thereby to obtain extremely good copy images.

Further, with use of the toner for developing electrostatic latent images of the present invention, the method for forming images can form extremely favorable images as mentioned above.

Moreover, with use of the toner for developing electrostatic latent images of the present invention, the apparatus for forming images can form extremely favorable images with employment of apparatuses conventionally used.

What is claimed is:

1. A toner for developing electrostatic latent images comprising:

a colorant;

a polyester resin;

a negative charge controlling agent comprised of a chromium complex compound; and a positive charge controlling agent, wherein the polyester resin has an acid value Z of 15 to 33 mgKOH/g, a hydroxyl value Y of 4 to 17 mgKOH/g, a number average molecular weight (Mn) of 5200–7000, a glass transition point (Tg) of 60 to 70° C., and a 4 mm-descending temperature of 160 to 175° C.

2. A toner according to claim 1, wherein the chromium complex compound is represented by the formula:

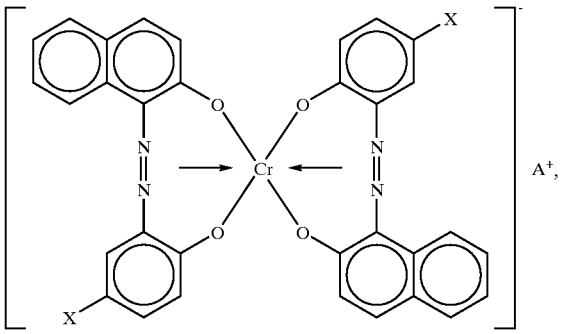

wherein X is Cl, Br, $SO_2NH_2$, $SO_2CH_3$ or $SO_2C_2H_5$, and $A^+$ is a $C_{8-16}$ straight-chain alkylammonium or a $C_{8-16}$ branched alkylammonium in which the alkyl moiety is optionally interrupted by a hetero atom.

3. A toner according to claim 1, further comprising fluidizing agent particles.

4. A toner according to claim 1, wherein the fluidizing agent particles have a specific surface area of 90 to 240 $m^2/g$.

5. A toner according to claim 1, wherein further comprising a fixing/releasing agent, a dispersant, or magnetic powder.

6. A toner according to claim 1, wherein the polyester resin is at least one selected from the group consisting of unsaturated polyester resins, alkyd resins, polyethylene terephthalates, polybutylene terephthalates and polyarylates.

7. A toner according to claim 1, wherein the polyester resin is a polymer combined by ester bonding through polycondensation of a polybasic acid and a polyhydric alcohol.

8. A toner according to claim 7, wherein the polybasic acid forming the polyester resin is at least one selected from the group consisting of maleic acid, maleic anhydride, fumaric acid, citraconic acid, itaconic acid, mesaconic acid, phthalic anhydride, isophthalic acid, terephthalic acid, succinic anhydride, adipic acid, azelaic acid, sebacic acid, tetrahydrophthalic anhydride, hexahydrophthalic anhydride, tetrabromophthalic anhydride, tetrachlorophthalic anhydride, HET anhydride, endomethylene tetrahydrophthalic anhydride, trimellitic acid, trimellitic anhydride, pyromellitic acid and pyromellitic anhydride; and the polyhydroxy alcohol is at least one selected from the group consisting of ethylene glycol, propylene glycol, 1,2-butanediol, 1,4-butanediol, 1,3-butylene glycol, 1,6-hexanediol, 1,5-pentanediol, 1,6-pentanediol, diethylene glycol, dipropylene glycol, neopentyl glycol, triethylene glycol, hydrogenated bisphenol A, polyoxyethylenated bisphenol A, polyoxypropylenated bisphenol A, bisphenol dihydroxypropyl ether, glycol and glycerol.

9. A toner according to claim 1, wherein the polyester resin is contained in an amount of about 80 to 95 wt % with respect to the total weight of the toner.

10. A toner according to claim 1, wherein the chromium complex compound is contained in an amount of about 0.5 to 5 wt % with respect to the total weight of the toner.

11. A toner according to claim 1, wherein the positive charge controlling agent is at least one selected from the group consisting of nigrosine dyes, pyridinium salts, ammonium salts and lake compounds thereof.

12. A toner according to claim 1, wherein the positive charge controlling agent is contained about 0.05 to 0.5 wt % with respect to the total weight of the toner.

13. A method for forming images comprising developing electrostatic latent images with the tuner of claim 1.

* * * * *